US010794661B2

(12) United States Patent
Irvin et al.

(10) Patent No.: US 10,794,661 B2
(45) Date of Patent: Oct. 6, 2020

(54) COLLAPSIBLE BUTTSTOCK WITH AUTOMATIC DEPLOYMENT

(71) Applicants: Robert Irvin, Hilliard, OH (US); George W. Bush, Columbus, OH (US); Samer Alkhalaileh, Dublin, OH (US); Joshua K. Cox, Marysville, OH (US)

(72) Inventors: Robert Irvin, Hilliard, OH (US); George W. Bush, Columbus, OH (US); Samer Alkhalaileh, Dublin, OH (US); Joshua K. Cox, Marysville, OH (US)

(73) Assignees: Robert Irvin, Hilliard, OH (US); George W. Bush, Columbus, OH (US)

( * ) Notice: Subject to any disclaimer, the term of this patent is extended or adjusted under 35 U.S.C. 154(b) by 0 days.

(21) Appl. No.: 15/215,812

(22) Filed: Jul. 21, 2016

(65) Prior Publication Data

US 2017/0023328 A1 Jan. 26, 2017

Related U.S. Application Data

(60) Provisional application No. 62/195,114, filed on Jul. 21, 2015.

(51) Int. Cl.
*F41C 23/04* (2006.01)
*F41C 23/06* (2006.01)

(52) U.S. Cl.
CPC ..... *F41C 23/04* (2013.01); *F41C 23/06* (2013.01)

(58) Field of Classification Search
CPC ..... F41C 23/00; F41C 23/04; F41C 23/06; F41C 23/10; F41C 23/12; F41C 23/14; F41C 23/20
USPC ..... 42/71.01, 71.02, 72, 73, 74
See application file for complete search history.

(56) References Cited

U.S. PATENT DOCUMENTS 593,890 A * 11/1897 Houston ..... F41C 23/12 42/72
2,424,194 A 7/1947 Sampson et al.
2,466,017 A * 4/1949 Farber ..... F41A 9/83 42/72
3,137,958 A * 6/1964 Lewis ..... F41C 23/14 42/73
3,793,759 A * 2/1974 Deckard ..... F41C 23/12 42/1.11
6,564,492 B2 5/2003 Weldle et al.
8,061,072 B1 11/2011 Crose
(Continued)

*Primary Examiner* — Bret Hayes
(74) *Attorney, Agent, or Firm* — Taylor Intellectual PLLC; James W. Taylor, II

(57) ABSTRACT

A collapsible buttstock with automatic deployment has a housing with an opening providing clearance for a buffer tube. Rods slidably couple through respective openings in the housing; the rods each having a hollow cavity accommodating biasing structure for exerting a biasing force against a respective attachment member. A locking element has locking blocks, each engaging a respective one of plural notches on the rods, for locking the rods to an operator support buttstock element, each of the locking blocks comprising a tapered surface. A release trigger with a contoured step engages the tapered surfaces of the locking blocks. When the release trigger is moved, the contoured step engages the tapered surfaces to push locking blocks away from engagement with the notches on the rods, thus allowing the biasing member in each rod to push the respective rod and the operator support buttstock element away from the housing.

1 Claim, 25 Drawing Sheets

(56) References Cited

U.S. PATENT DOCUMENTS

| | | | | |
|---|---|---|---|---|
| 8,943,947 | B2 | 2/2015 | Gomez | |
| 2014/0190056 | A1* | 7/2014 | Troy | F41C 23/14<br>42/71.01 |
| 2016/0116249 | A1* | 4/2016 | Maugham | F41C 23/08<br>42/74 |
| 2016/0305738 | A1* | 10/2016 | Huang | F41C 23/04 |

* cited by examiner

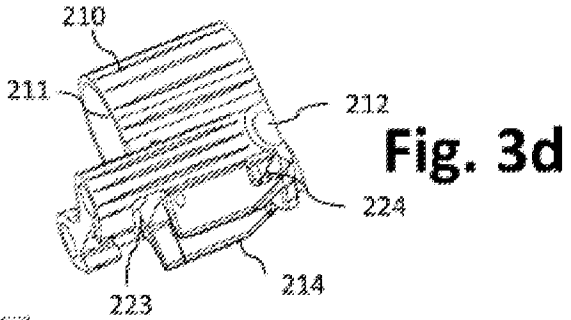
Fig. 3d
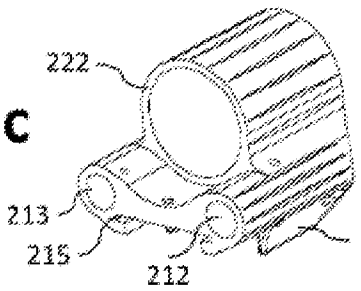
Fig. 3c
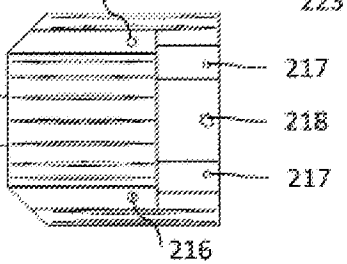
Fig. 3e
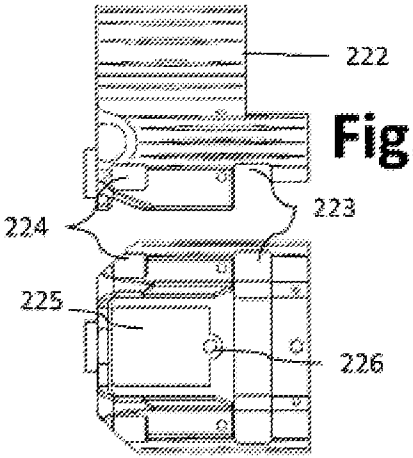
Fig. 3f
Fig. 3i
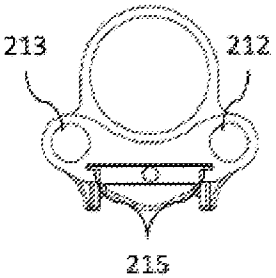
Fig. 3g
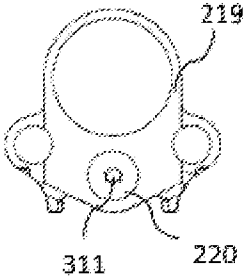
Fig. 3h

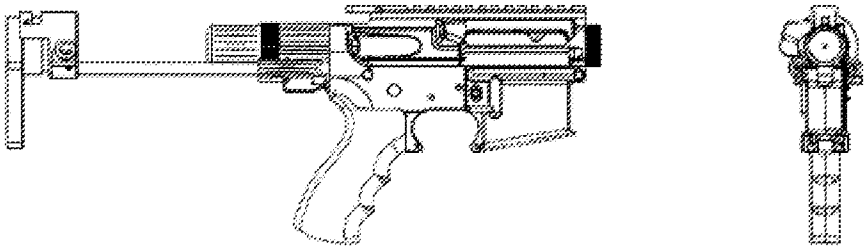
Fig. 14a
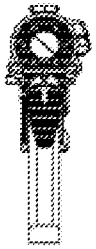
Fig. 14b
Fig. 14c
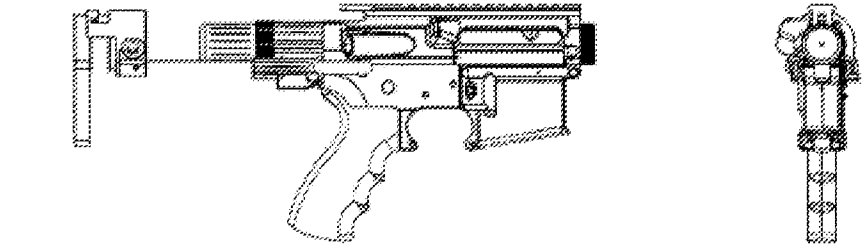
Fig. 14d
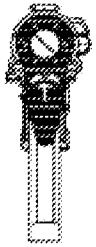
Fig. 14e
Fig. 14f
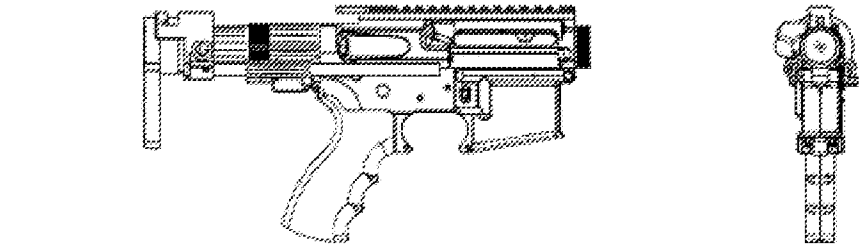
Fig. 14g
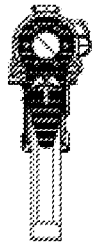
Fig. 14h
Fig. 14i

COLLAPSIBLE BUTTSTOCK WITH AUTOMATIC DEPLOYMENT

This application is a non-provisional of U.S. patent application Ser. No. 62/195,114, filed Jul. 21, 2015 the contents of which are incorporated herein by reference.

FIELD OF THE INVENTION

The invention is directed to a collapsible buttstock attached to a firearm having an energy storage device, which, upon release of the stored energy, automatically and rapidly moves the butt stock from a locked collapsed position to a fully or partially extended position—thus enabling the firearm operator to position the buttstock in the proper shoulder location and allowing the operator to better control the firearm and make accurate shots.

BACKGROUND OF THE INVENTION

Members of the armed forces and law enforcement worldwide utilize several types of firearms, which generally fall into three main categories, hand guns (FIG. 1*d*), submachine guns (FIG. 1*c*) and rifles (FIG. 1*a*). Carbines may also be considered under the rifle category and the terms carbine and rifle may be used interchangeably hereinafter to refer to firearms in the rifle category. Selection of the type of weapon to be used depends mainly on the task at hand. Amongst the aforementioned firearms categories, the rifle offers the best accuracy and the longest effective range exceeding 600 yards, which also depends on the type of ammunition being used. The most common are the 5.56 mm and 7.62 mm cartridges. The submachine gun comes in second place after the rifle in accuracy and effective range. This category of firearms utilizes the same ammunition utilized in a handgun, cartridges such as 9 mm, .40S&W and 45ACP. The effective range for a submachine gun is about 150 yards, whereas, that of a handgun is about 25 yards. Although the rifle offers the longest effective range, it is also the largest and heaviest of the aforementioned categories. Space, and to a lesser extent weight, limitations may constrain the firearm selection to one with shorter effective range and less accuracy, such as a submachine gun or even a handgun when space requirements are exceedingly restricted. This immediately puts the firearm operator at a disadvantage when facing an enemy with superior firearm capability.

The rifle and submachine gun both provide a three point contact while taking aim and firing the firearm. Both hands hold the firearm and the buttstock is held against the shoulder, thus providing three points of contact for an improved firearm control over the handgun, which, at most, provides only two points of contact (two hands).

The buttstock on a rifle (FIG. 1*a*) serves two general functions: first, it provides a third point of contact allowing proper positioning of the firearm, the two hands holding the firearm providing the first and second points of contact. The buttstock allows the firearm operator to position the carbine in a stable position supported by the point of contact between the buttstock and the operator's shoulder. That is, when firing, the buttstock properly sets on the user's shoulder when the firearm is held orthogonally to the user's body, with the bottom of the firearm pointing straight down toward the ground, this position is called proper shoulder location. Second function: the buttstock is the conduit to channel recoil energy into the operator's body. Proper firearm position (shoulder/buttstock contact) is also the best point of contact to dissipate recoil energy into the operator's body when a round is discharged. The buttstock transmits recoil energy generated by the discharged round into the point of contact (the shoulder), dissipation of recoil energy through the buttstock into the operator shoulder allows the operator to better control the firearm and keep the firearm on target for a follow up shot.

A buttstock is essential for the accurate firing and control of the firearm. However, the conventional buttstock (FIG. 1*a*) presents a deterrent to meeting limited weight and space requirements. Hence, it has been suggested that a collapsible buttstock be used with the rifle, for example, by GOMEZ U.S. Pat. No. 8,943,947 B2, by CROSE U.S. Pat. No. 8,061,072 B1, by WELDEL U.S. Pat. No. 6,564,492 B2, and by Sampson U.S. Pat. No. 2,424,194.

Collapsible buttstocks (FIGS. 1*e* & 1*f*) provide a practical solution to the weight and space restrictions that a conventional buttstock fails to address. However, when the need arises to deploy a collapsible buttstock, there is limited time to react and get the gun in a fire ready position. The firearm operator might be in a stressful situation or even taking fire from an enemy. Deploying the collapsible buttstock under such circumstances becomes an ordeal. Even if the firearm operator is able to deploy the collapsible buttstock, valuable time will have been spent extending the collapsible buttstock, time in which the operator is not firing and possibly taking fire.

Therefore, there is a need to develop a collapsible buttstock that can be deployed quickly and with the least amount of effort.

SUMMARY OF THE INVENTION

The present disclosure is directed to a collapsible buttstock for a firearm. The buttstock can be collapsed and locked in the collapsed position. The buttstock can be expanded automatically utilizing the release of stored energy within an energy storage device, the released energy displacing the buttstock away from the firearm. The buttstock can further be locked in multiple expanded positions, as disclosed herein below. According to a first aspect, a method of manufacturing a collapsible buttstock with automatic deployment (CBAD) comprises: attaching a first housing to a firearm, the housing is affixed to the firearm and provides clearance for a buffer tube, the buffer tube goes through an opening that traverses the housing longitudinally, and attaches to the firearm, doing so the buffer tube applies pressure to the back side of the housing, thus, securing the housing to the firearm. The housing attached to the firearm supports two rods that slide through two openings that traverse the housing longitudinally, one end of the rods can slide towards and away from the firearm. A second housing (buttstock shoulder support) is affixed to the other ends of the rods. The two rods can move with respect to the firearm, while being guided by the openings in the first housing, hence, the buttstock shoulder support (BSS) can move with respect to the firearm, the rods are hollow to allow placement of helical spring within them, the rods also have notches positioned on the outside diameter of the rods and along the length of the rods, these notches allow locking the rods in different positions with respect to the firearm.

According to a second aspect, the aforementioned first housing encompasses a mechanism that locks the position of the rods, hence, the BSS in multiple positions with respect to the firearm.

According to a third aspect, two helical springs are disposed between the BSS and the first housing; the two helical springs are located inside the two hollow rods which attach the shoulder BSS to the first housing, the helical springs are configured in such a way that when the BSS is in the collapsed position, the helical springs are fully or partially compressed. The two rods, hence, the BSS is locked in a collapsed position by the locking mechanism within the first housing. Upon the release of the locked rods, the potential energy stored within the helical springs will be released and will push the BSS away from the firearm body. The locking mechanism may be actuated to lock the rods in one of multiple expanded positions with respect to the firearm.

In certain aspects, the first housing comprises three openings that longitudinally traverse the housing, one for the buffer tube and two for the guide rods. The first housing also comprises an alignment pin protruding from the housing front side facing the firearm, the function of the alignment pin is to maintain the orientation of the housing and the firearm and avoid inadvertent rotation of the housing.

In certain aspects, the first housing comprises a locking mechanism comprised of two locking blocks and a guide block that contacts both blocks, the blocks move against each other, their movement is constrained by channels within the first housing and their tapered surfaces touching each other. Furthermore, two helical springs within the locking mechanism bias the locking mechanism in a normally locked position (unless activated by the operator, the locking mechanism maintains the rods' position in the selected position).

In certain aspects, the CBAD device further comprises two helical springs, wherein the helical springs are contained within the hollow rods and each helical spring is restricted at both ends, one end is restricted by a pin secured to the first housing, another pin is secured to the BSS and restricts the other end of the helical spring.

In certain aspects, the CBAD device comprises a BSS, the BSS is secured to the guide rods, the BSS has an opening at one side, the opening provides clearance for the buffer tube when the BSS is in the fully collapsed position

BRIEF DESCRIPTION OF THE DRAWINGS

The features of the present invention will best be understood from a detailed description of the invention and a preferred embodiment thereof selected for the purposes of illustration and shown in the accompanying drawings in which:

FIG. 1*e* illustrates a side view of a conventional collapsible buttstock for a submachine gun type firearm.

FIG. 1*f* illustrates a side view of another style of conventional collapsible buttstock for a rifle type firearm.

FIG. 3*c* illustrates a rear perspective view of the housing for a CBAD module.

FIG. 3*d* illustrates a side perspective view of the housing for the CBAD module.

FIG. 3*e* illustrates a top view of the housing for the CBAD module of FIG. 3*a*.

FIG. 3*f* illustrates a side view of the housing for the CBAD module of FIG. 3*a*.

FIG. 3*g* illustrates a rear view of the housing for the CBAD module of FIG. 3*a*.

FIG. 3*h* illustrates a front view of the housing for the CBAD module of FIG. 3*a*.

FIG. 3*i* illustrates a bottom view of the housing for the CBAD module of FIG. 3*a*.

FIG. 14*a* is a side view of a firearm with a CBAD module with an RMBF attached to it, the CBAD is in the fully extended position, "position 3."

FIG. 14*b* is a rear view of a firearm with a CBAD module with an RMBF attached to it of FIG. 14*a*.

FIG. 14*c* is a front view of a firearm with a CBAD module with an RMBF attached to it of FIG. 14*a*.

FIG. 14*d* is a side view of a firearm with a CBAD module with an RMBF attached to it, the CBAD is in the partially extended position, "position 2."

FIG. 14*e* is a rear view of a firearm with a CBAD module with an RMBF attached to it of FIG. 14*d*.

FIG. 14*f* is a front view of a firearm with a CBAD module with an RMBF attached to it of FIG. 14*d*.

FIG. 14*g* is a side view of a firearm with a CBAD module with an RMBF attached to it, the CBAD is in the fully collapsed position, "position 1."

FIG. 14*h* is a rear view of a firearm with a CBAD module with an RMBF attached to it of FIG. 14*g*.

FIG. 14*i* is a front view of a firearm with a CBAD module with an RMBF attached to it of FIG. 14*g*.

DETAILED DESCRIPTION

Figure 1A:
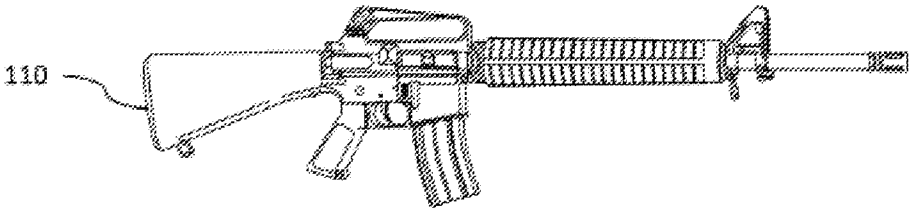
FIG. 1*a* illustrates a side view of a conventional rifle (an AR15 or M16 style rifle) with a conventional fixed buttstock.

The present disclosure is directed to a Collapsible buttstock with Automatic deployment (CBAD) device and CBAD adapter mechanism for firearms. Preferred embodiments of the present invention will be described hereinbelow with reference to the figures of the accompanying drawings. In the following description, well-known functions or constructions are not described in detail, since such descriptions would obscure the invention in unnecessary detail.

For the purpose of promoting an understanding of the principles of the claimed technology and presenting its currently understood, best mode of operation, reference will be now made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would typically occur to one skilled in the art to which the claimed technology relates.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage, or mode of operation.

Figure 1B:
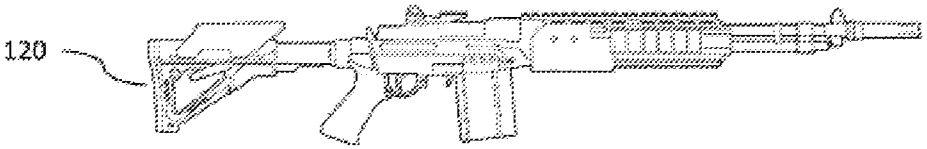
FIG. 1*b* illustrates a side view of a conventional rifle with a collapsible buttstock
Figure 1C:
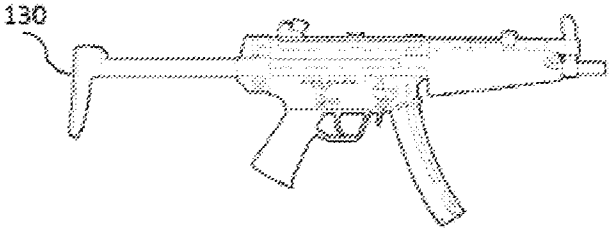
FIG. 1*c* illustrates a side view of a conventional submachine gun with a collapsible buttstock.
Figure 1D:
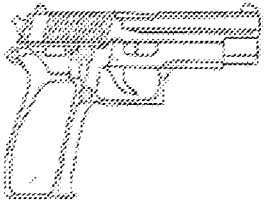
FIG. 1*d* illustrates a side view of a conventional semi-automatic hand gun.
Figure 2B:
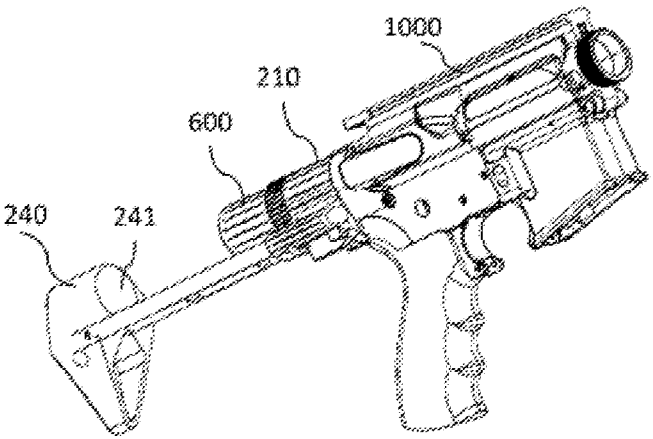
FIG. 2*b* illustrates a side perspective view of the firearm with a CBAD of FIG. 2*a*.
Figure 2A:
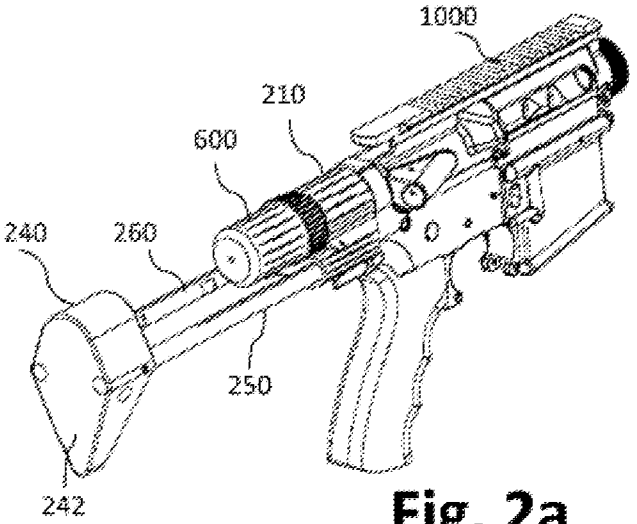
FIG. 2*a* illustrates a rear perspective view of a firearm with a collapsible buttstock with automatic deployment (CBAD) and a buttstock shoulder support (BSS).
Figure 2C:
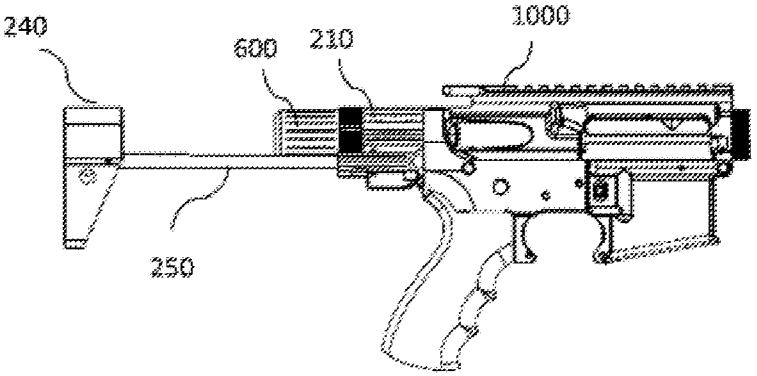
FIG. 2*c* illustrates a side view of the firearm with CBAD of FIG. 2*a*.
Figure 2E:
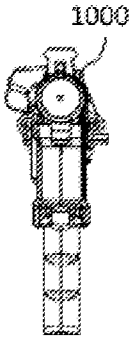
FIG. 2*e* illustrates a front view of the firearm with CBAD of FIG. 2*a*.
Figure 2D:
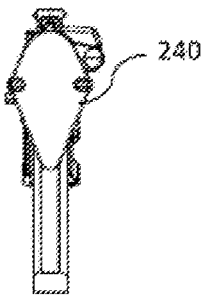
FIG. 2*d* illustrates a back view of the firearm with CBAD of FIG. 2*a*.

A conventional fixed buttstock 110 attached to a rifle is illustrated in FIG. 1*a*. A collapsible buttstock 120 attached to a rifle is shown in FIG. 1*b*. Furthermore, a collapsible buttstock 130 attached to a submachine gun is illustrated in FIG. 1*c*. FIG. 1*a* illustrates a side view of a conventional buttstock attached to an AR15 or M16 style rifle. FIG. 1*b* illustrates a side view of a collapsible buttstock attached to an M14 type rifle, and FIG. 1*c* illustrates a side view of a collapsible buttstock attached to a submachine gun type firearm. The buttstock generally refers to the part of a rifle, or a submachine gun or other firearm, to which the firing mechanism is directly attached. The buttstock is held against one's shoulder when firing the gun.

A collapsible buttstock makes the firearm more compact for storage or transport, but is usually deployed before shooting to enhance control. A collapsible buttstock collapses by telescoping (or sometimes folding) in on itself. As will be discussed below, a collapsible buttstock may employ more than one length setting, allowing the buttstock to be adjusted for different users and different firing modes.

The collapsible buttstocks in FIG. 1*e* may be attached to a submachine gun, this style of collapsible buttstock attaches to the firearm by securing the housing 160 to the firearm. The BSS 140 is supported by the two guide rods 160, the BSS and the guide rods together form an assembly that can be moved and locked at a variety of positions with respect the firearm the collapsible buttstock is attached to. The housing 160 also comprises a mechanism (not shown) that allows locking the shoulder support and rods assembly in a variety of positions ranging from fully collapsed to fully extended positions, the operator of the firearm determines which position to lock the BSS, depending on operator's preference and the prevailing circumstances.

Similar to the aforementioned collapsible buttstock, figure if illustrates a comparable buttstock that shares the same components with one difference, the collapsible buttstock in figure if can be used with AR style rifles, which utilize a buffer tube 150, whereas the collapsible buttstock in FIG. 1*e* can only be used with firearms that do not require a buffer tube, such as submachine guns. The housing 170 also contains a release trigger 190 and a safety mechanism 180.

Collapsible buttstocks are generally known, the inventive buttstock enables the firearm operator to automatically extend the buttstock to a fire-ready position with speed and little effort, thus, saving precious seconds, which would otherwise be spent getting the buttstock extended while possibly taking fire and being unable to return fire at an enemy. Saving a few seconds under such conditions could increase the chances of survivability of the firearm operator and those whom the operator might be trying to protect.

FIGS. 2*a*-2*e* and FIGS. 3*a*-3*o* illustrate the main components of the CBAD module. A housing 210 is secured to a firearm 1000, the housing exterior is shaped so as support the firearm operator's cheek when the operator is taking aim through the firearm's sights. Housing 210, as illustrated in FIGS. 3*c*-3*i*, comprises three openings that traverse it longitudinally 211, 212 and 213. Openings 212 and 213 are similar in size. These openings support the guide rods 250 and 260, respectively. Opening 211 is sized to allow clearance for the front portion 606 of the buffer tube 600 to go through it. The threaded portion at the front of the buffer tube 602 is threaded into the firearm. The buffer tube 600 has a stepped diameter, the larger diameter has an undulating or wavy contour 601, the distance between the larger and smaller diameters forms a rim 603, as the buffer tube is threaded into the firearm, rim 603 makes contact with the back face 222 of housing 210, the pressure from the rim 603 onto the back face 222 of the housing keeps the housing secured to the firearm. Housing 210 comprise four openings (two of each 216 and 217) that traverse it vertically, openings 216 are configured to receive two roll pins 270, and openings 217 receive two roll pins 280. Also, the housing comprises a threaded hole 218 that traverses it vertically, this threaded hole receives a set screw 290. When set screw 290 is threaded into the hole 218, it makes contact with the buffer tube surface 601 and locks it in place.

Housing 210 also comprises two channels 215, these channels support and guide the release trigger 300. A protrusion 220 extends from the front face 219 of the housing, upon assembly of the housing to the firearm, this protrusion is inserted into a matching hole in the firearm body and prevents the housing from rotating. Housing 210 comprises a threaded hole 311, this hole is located at the center of the protrusion 220 and receives a spring loaded plunger.

Housing 210 comprises a rim 214 at the bottom side, the outside surface of the rim protects from inadvertent contact with release trigger 300, and the inner surface of the rim defines a guide for the operator's thumb to assist the firearm operator in finding and pushing the release trigger when needed.

Figure 3A:
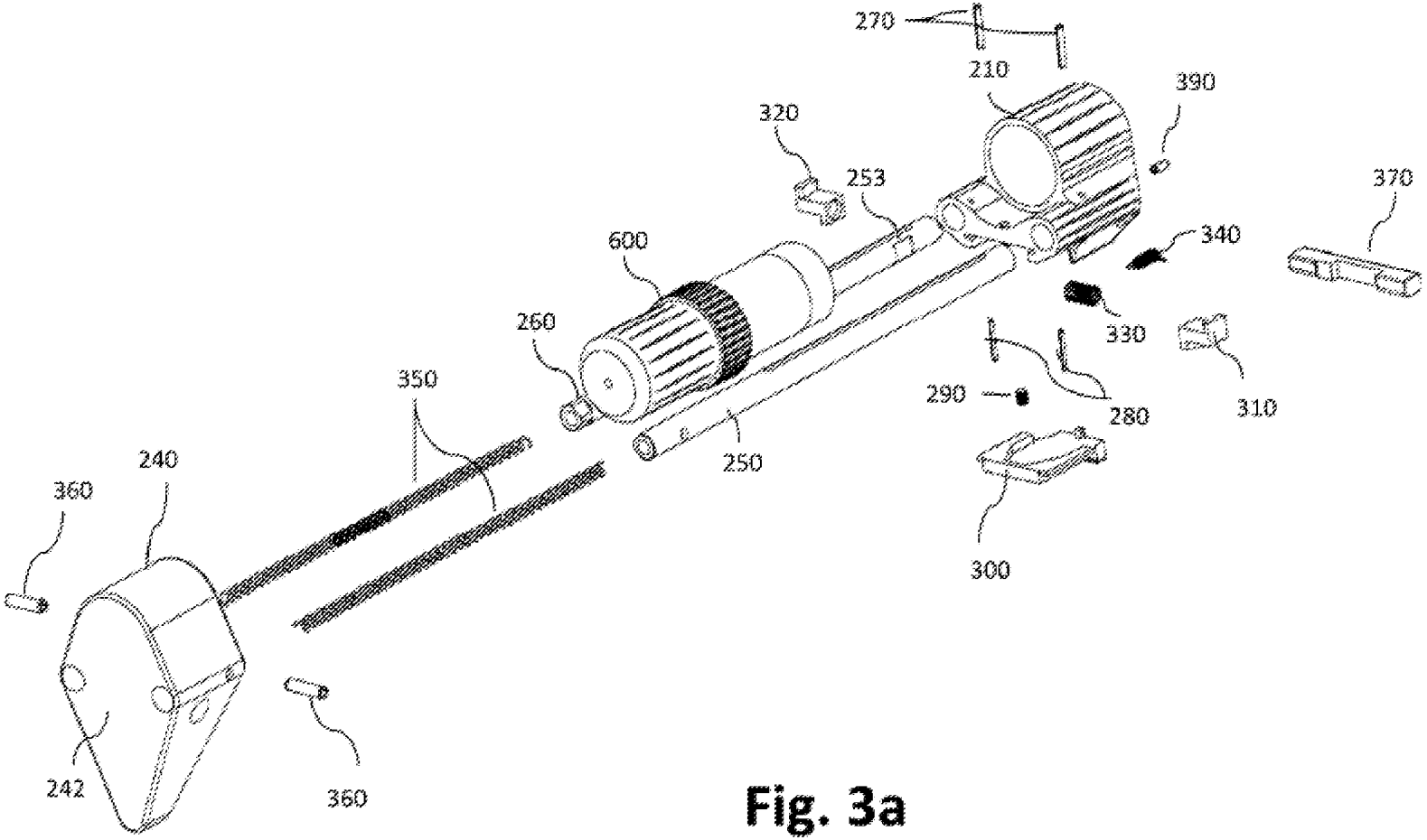
FIG. 3*a* illustrates rear perspective view of an assembly of a CBAD module.

Housing 210 also holds the components for locking and releasing the buttstock, the bottom of the housing comprises a groove 223 that traverses the housing crosswise and is closer to the backside 222 of the housing, as illustrated in FIG. 3*f*. The groove defines a channel for locking blocks 310 and 320 to be placed in, as illustrated in FIG. 3*a*. When assembled helical spring 330 is disposed between the two blocks, also, the bottom of the housing comprises an opening with a rectangular cross section 224 that traverses the housing crosswise and is closer to the front side of the housing 219. This opening receives the safety bar 370. A post 226 protrudes within a cavity 225 at the bottom of the housing illustrated in FIG. 3*i*, the post 226 provides an anchor for extension helical spring 340.

Figure 3B:
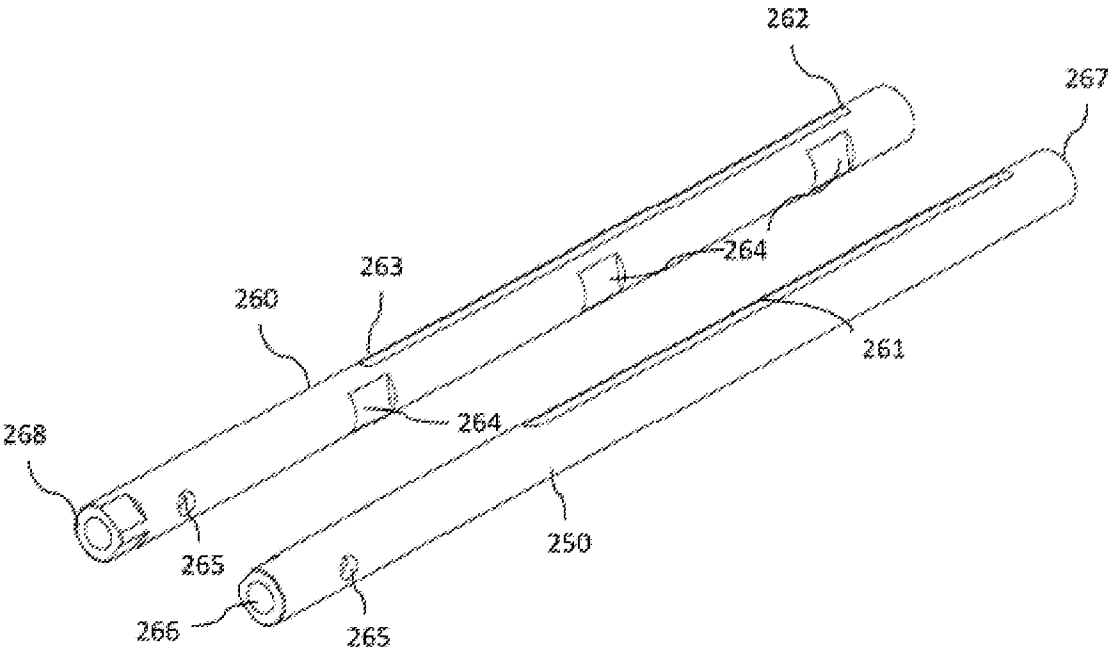
FIG. 3*b* illustrates a rear perspective view of the two guide rods used in the CBAD module.

The two rods 250 and 260 illustrated in FIGS. 3*a* and 3*b*, are inserted into openings 212 and 213 respectively, the front end of the rods 267 is first inserted into the openings, these rods are aligned with the slots 261 openings pointing upwards, as illustrated in FIG. 3*b*. Once the slots 261 cross holes 216 (FIG. 3*e*) are aligned, roll pins 270 (FIG. 3*a*) can be inserted and will go through the slots 261 and holes 216, the interaction between the pins 270 and the slots 261 maintains the alignment of the guide rods 250 and 260 and limits their travel to the extent of the slot length.

The housing, the locking blocks, the release trigger, the guide rods and the BSS may be made out of ferrous or non-ferrous metals or alloys thereof, they can also be made out of polymers, composites or any material that can be machined, molded, cast or formed otherwise.

The helical springs may be made out of alloy steel or other ferrous and non-ferrous metals and alloys thereof, the helical springs can also be made out of polymers or any material that can be elastically deformed and stores energy and upon restoration of its original form it discharges the stored energy. Helical springs 350 preferred spring constant "k" is 5 lb/in, and may range from 0.1 lb/in to 100 ld/in. Furthermore, the helical springs may be replaced by an energy storage device which stores energy as it is being compressed and upon release of the stored energy, the device expands and recovers its original physical dimensions. Several such embodiments may be hydraulic or pneumatic cylinders.

The guide rods 250 and 260 (FIG. 3*b*) are hollow, creating a cavity to receive helical springs 350 (FIG. 3*a*), the rods are circular to match the mating openings 212 and 213 in the housing. In other embodiments, the guide rods may be elliptical, half round, rectangular, triangular or any other geometric shapes as long as the receiving opening has the matching geometry. The guide rods have notches 264, a minimum of two notches per rod corresponding to the fully extended and fully retracted buttstock positions are needed. There is no maximum number of notches, the maximum number of notches is limited by the amount of space available on the rods. In the current embodiment, each guide rod will have three notches, which correspond to three positions. The notches are configured to be slightly wider than the locking blocks 310 and 320 (FIG. 3*a*). When the guide rods are assembled into the housing and the pins 270 (FIG. 3*a*) are inserted into the pin hole and pass through the slots 261, the notches will be facing the housing, specifically the groove 223 (FIG. 3*i*), this configuration allows locking blocks 310 and 320 that will be contained within the groove 223 to communicate with the notches when the notches and groove are aligned.

Figure 3J:
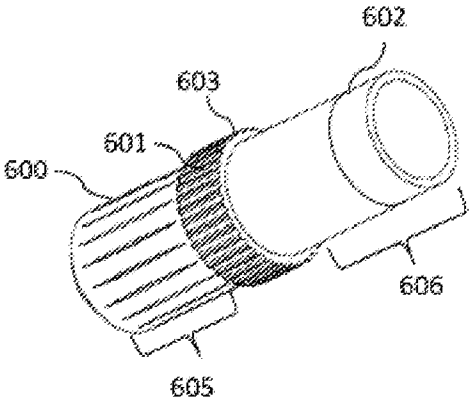
FIG. 3*j* illustrates a front perspective view of the buffer tubes used with the CBAD module.
Figure 3L:
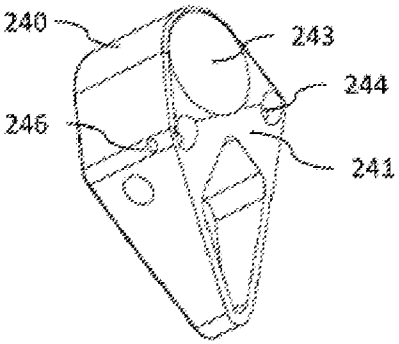
FIG. 3*l* illustrates a front perspective view of the BSS used with the CBAD module.
Figure 3K:
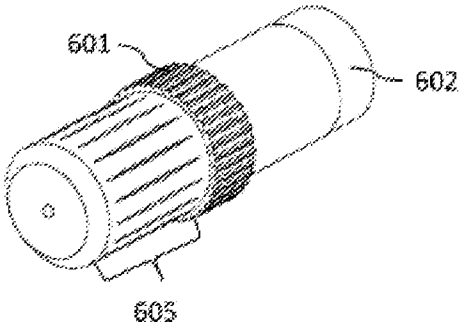
FIG. 3*k* illustrates a rear perspective view of the buffer tubes of FIG. 3*j*.
Figure 3M:
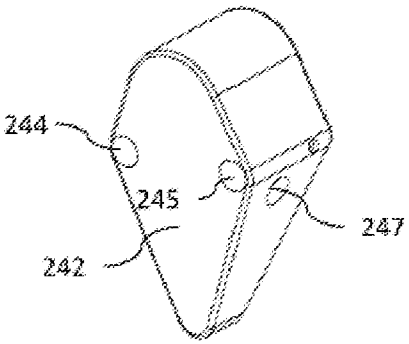
FIG. 3*m* illustrates a rear perspective view of the BSS used with the CBAD module of FIG. 3*l*.

The buttstock shoulder support (BSS) 240 (FIGS. 2*a*-2*c* and FIGS. 3*a,g* 3*l*, and 3*m*) is a housing that has a front side 241 and a back side 242. The front side comprises an opening 243 (FIG. 3*l*) that axially and partially penetrates the housing. The opening is sized so that it larger than the outside contour of the rear part 605 of the buffer tube 600 (FIGS. 3*j* and 3*k*). This configuration allows the BSS to telescopically move over the rear part of the buffer tube when the buttstock is collapsed. The BSS also comprises two openings 244 and 245 (FIGS. 3*l* and 3*m*). These openings axially penetrate the BSS and are sized so that the guide rods 250 and 260 (FIG. 3*b*) can be inserted and the back side 268 of the guide rods 250 and 260 (FIG. 3*b*) can be seen when looking directly at the back side of the BSS. The BSS housing also comprises an opening 246 that traverses the housing crosswise, the guide rods also each comprises an opening 265 (FIG. 3*b*) of similar size as opening 246. The guide rods 250 and 260 are pushed into the openings 245 and 244, until the crosswise openings 246 (from buttstock) and crosswise openings 265 (from guide rods) are aligned. Alignment of the aforementioned openings allows insertion of the roll pins 360 which will traverse both openings and secure the BSS 240 to the guide rods. Finally the BSS comprises two holes 247, these holes are configured to receive quick disconnect sling swivels.

Figure 3N:
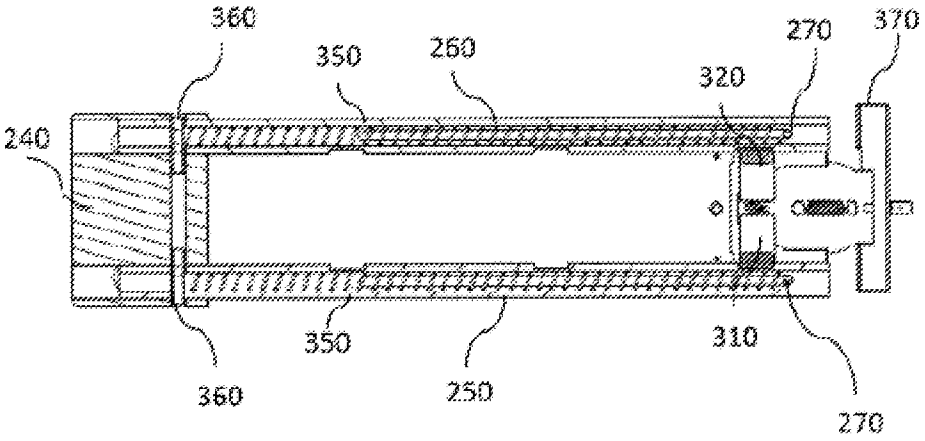
FIG. 3*n* illustrates a cross sectional top view of the CBAD module.
Figure 3O:
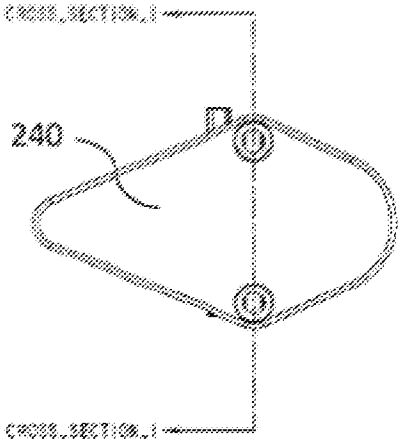
FIG. 3*o* illustrates a rear view of the CBAD module of FIG. 3*n*.
Figure 4A:
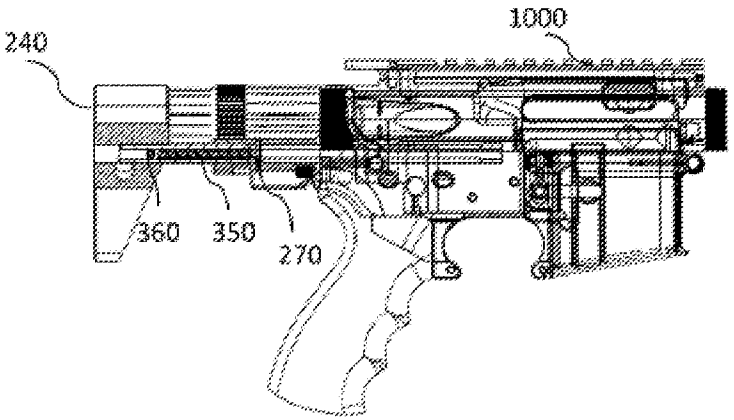
FIG. 4*a* is a cross sectional side view of a firearm with a CBAD module, the CBAD is in the fully collapsed position.
Figure 4B:
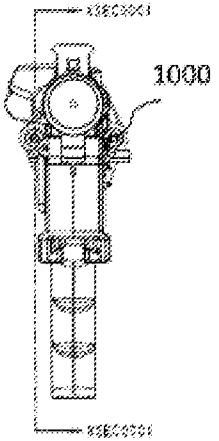
FIG. 4*b* is a front view of a firearm with a CBAD module of FIG. 4*a*.
Figure 4C:
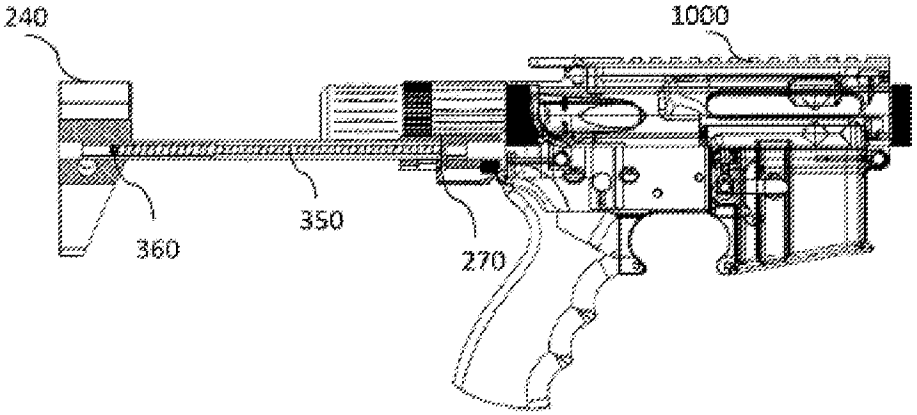
FIG. 4*c* is a cross sectional side view of a firearm with a CBAD module, the CBAD is in the fully extended position.
Figure 4D:
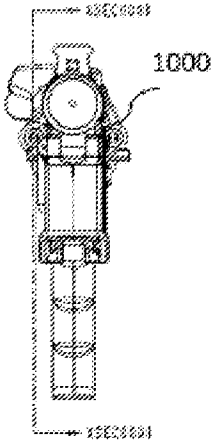
FIG. 4*d* is a front view of a firearm with a CBAD module of FIG. 4*c*.

When assembling the CBAD and before inserting the guide rods 250 and 260 into the BSS openings 244 and 245, the helical springs 350 (FIG. 3*a*) are inserted into the opening 266 (FIG. 3*b*) of the guide rods. Once the roll pins 360 have been inserted into the openings 246, the springs 350 become confined within the guide rods' cavity and the ends of the springs will be restricted by the roll pins 360 from the BSS side and roll pins 270 (FIG. 3*a*) from the housing side. FIG. 3*n* is a top cross sectional view of the CBAD illustrating how spring 350 is restricted by pins 270 and pins 360. Such configuration will cause the springs 350 to be compressed as the BSS is collapsed. FIG. 4*a* illustrates the collapsed buttstock and illustrates the compressed spring 350. At this position, the spring 350 has stored energy and is applying pressure against both pin sets 270 pins and 360 pins. When springs 350 are allowed to expand freely, the springs will expand in the direction of pin 360 (the direction of the BSS), the springs will continue to expand as long as the pin 270 has not made contact with the end 262 of the slot 261 (FIG. 3*b*), the interaction between pin 270 and end 262 of slot 261 will limit further helical spring 350 expansion and, therefore, the location of the BSS. FIG. 4*c* illustrates the BSS in full extension along with the spring 350 in fully extended condition.

Figure 5A:
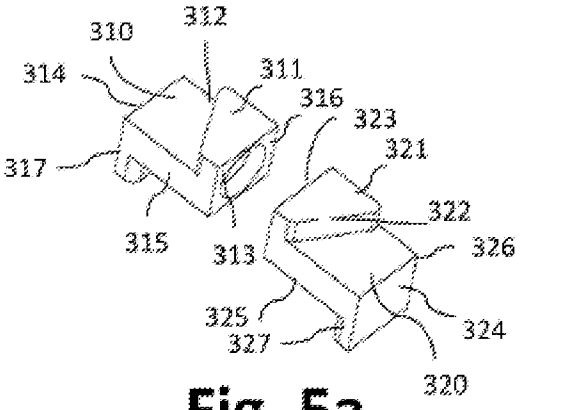
FIG. 5*a* is a top perspective view of the locking blocks for the CBAD module.
Figures 5B, 5C:
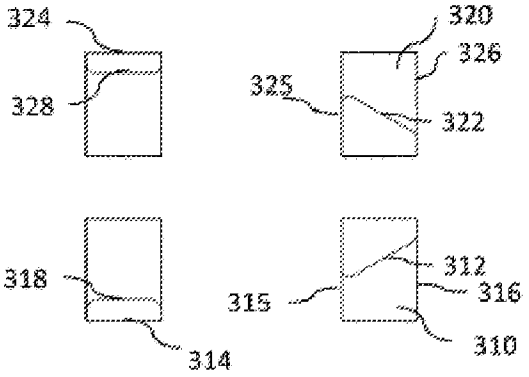
FIG. 5*b* is a bottom view of the locking blocks.
FIG. 5*c* is a top view of the locking blocks.

Next is a detailed description of the components and function of the CBAD buttstock locking mechanism and safety. FIGS. 5*a*-5*i* and FIGS. 6*a*-6*f* and FIGS. 8*a*-8*b* illustrate the components and the function of the locking and safety of the CBAD. Locking blocks 310 and 320 (FIG. 5*a*-5*c*) comprise a front side 314 and 324, a back side with an opening 313 and 323. The opening is sized to receive a helical spring 330 (FIG. 3*a*). A stepped thickness with two steps is on the top side 311 and 321, the shoulder of the steps on the top side of the locking block form a tapered surface rounded at the sides 312 and 322. The shoulder of the steps on the bottom side 317 and 327 of the block form a straight surface also with rounded sides 318 and 328. The sides 315 and 316 for block 310, and sides 325 and 326 for block 320 are parallel to each other within each block and are orthogonal to the front sides 314 and 324 and the top sides 311 and 321. Once the blocks are placed in the groove 223 (FIG. 3*i*), the sides of the blocks control and guide the movement of the blocks within the groove.

Figure 5D:
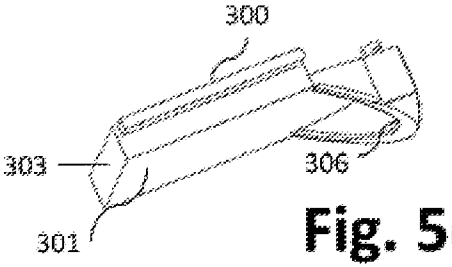
FIG. 5*d* is a bottom perspective view of the release trigger used in the CBAD module.
Figure 5E:
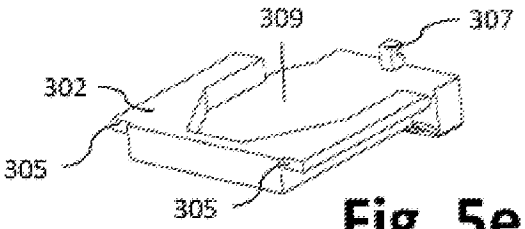
FIG. 5*e* is a rear perspective view of the release trigger of FIG. 5*d*.
Figure 5F:
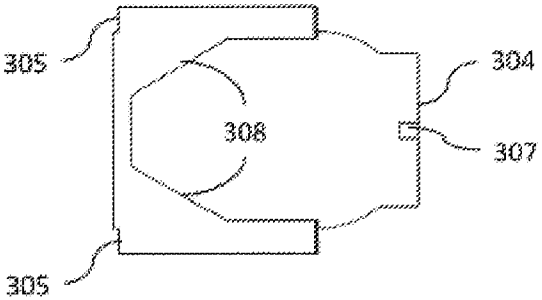
FIG. 5*f* is a top view of the release trigger of FIG. 5*d*.
Figure 5H:
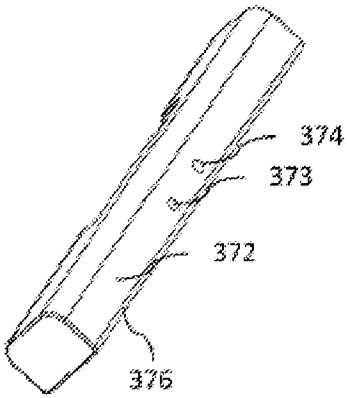
FIG. 5*h* is a rear perspective view of the safety bar of FIG. 5*g*.
Figure 5G:
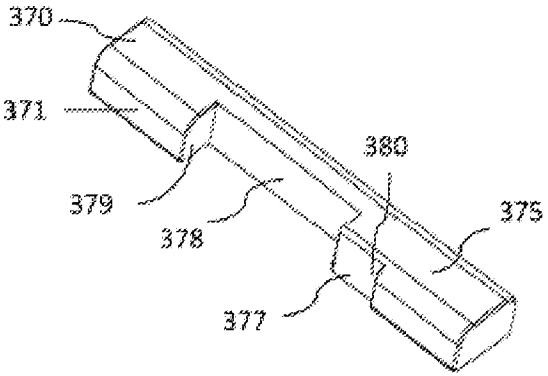
FIG. 5*g* is a front perspective view of the safety bar used in the CBAD module.

FIGS. 5*d*-5*f* illustrate details of the release trigger 300, the release trigger comprises a top side 302 a bottom side 301 a front side 304 and a back side 303, the top surface comprises a depressed surface 309, the distance between the top side 302 and the depressed surface 309 forms a step 308, the step is contoured in such a way that it will receive the locking blocks 310 and 320 oriented with their top surfaces 311 and 321 making contact with the depressed surface 309. Also, the tapered shoulders 312 and 322 on the locking blocks are in direct contact with the contoured step 308. The aforementioned arrangement is further illustrated in FIGS. 6*e* and 6*f*. A rectangular protrusion 307 extends from the depressed surface, this protrusion has a notch facing the front side of the release trigger, the notch acts as the second anchor for extension helical spring 340. The front side of the release trigger interacts with the safety bar 370. Two shelves 305 (one on each side of the release trigger) are received into the channels 215 (FIGS. 3*a*, 3*c*, and 3*g*) within the housing 210, the interaction between shelves and channels directs the longitudinal travel of the release trigger within the housing 210.

Figure 5I:
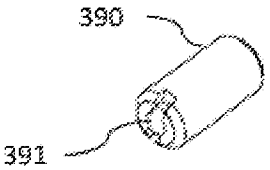
FIG. 5*i* is a perspective view of the spring-loaded plunger used in the CBAD module.
Figure 6A:
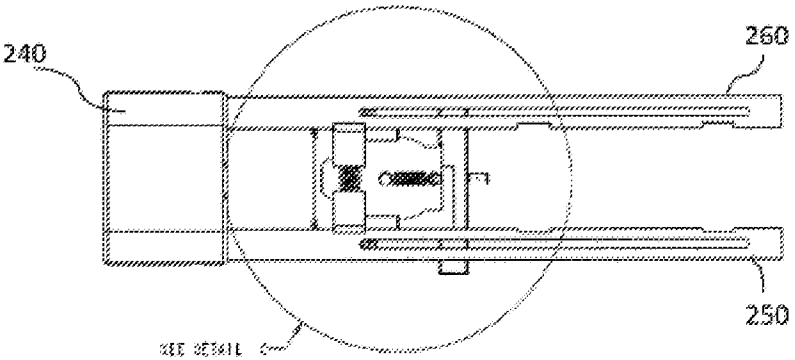
FIG. 6*a* is a top view of the CBAD module—CBAD module being in the fully collapsed position and the safety bar being in the "Safety on" position. The housing and the buffer tube are removed exposing details of the locking module.
Figure 6B:
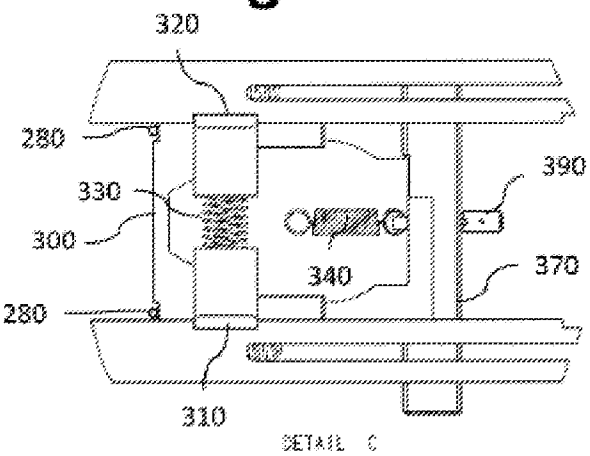
FIG. 6*b* is a detailed view of a portion of the top of the CBAD module of FIG. 6*a*, detailing some of the exposed components of the locking system.

The final component of the CBAD is the safety bar 370 (FIGS. 5*g* and 5*h*), the safety bar is a rectangular block with rounded edges, it has a top side 375 a bottom side 376, a front side 371 and a back side 372. The front side has two notches 377 and 378, the notches are bound by side walls 379 and 380, and the back side has two openings 373 and 374. The safety bar is inserted into the housing 210 in opening 224 (FIG. 3*d*), with openings 373 and 374 facing the threaded hole 311 in the housing 210 (FIG. 3*h*). The arrangement of safety bar and release trigger is shown in FIGS. 6*a* and 6*b*. The safety bar may traverse the housing crosswise from one side to the other, the crosswise travel is limited by the interaction between the side walls 379 and 380 and the sides of the release trigger 300. There is further interaction between the spring loaded plunger 390 (FIG. 5*i*)

and the openings 373 and 374 on the back side of the safety bar. In one position "safety on," the spring loaded ball 391at the tip of the plunger 390 will be partially inserted in opening 373, as also illustrated in FIG. 6*b*. In another position "safety off," the spring loaded ball at the end of the plunger will be partially inserted in opening 374 (FIG. 7*b*). The interaction between the spring loaded plunger and the safety bar will result in a firm stoppage of the movement of the safety bar, this stoppage allows the firearm operator to tell when the safety bar has been set to "safety on" or "safety off" position.

Figure 6C:
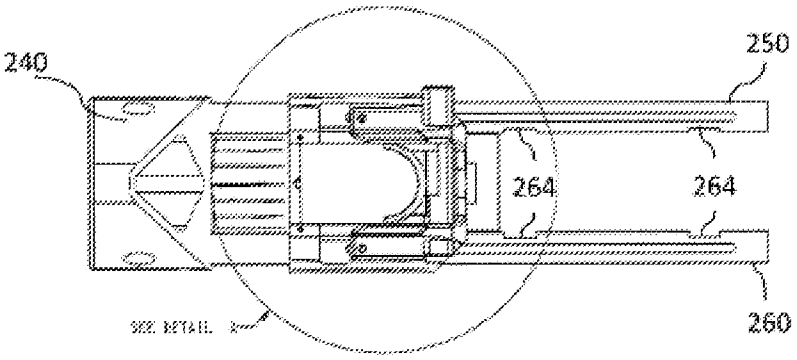
FIG. 6*c* is a bottom view of the CBAD module—the CBAD module being in the fully collapsed position and the safety bar being in the "Safety on" position.
Figure 6D:
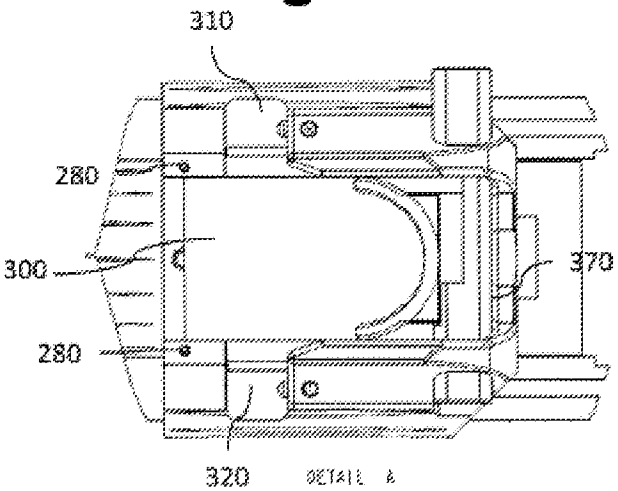
FIG. 6*d* is a detailed view of a portion of the bottom of the CBAD module of FIG. 6*c*, detailing the release trigger.
Figure 6E:
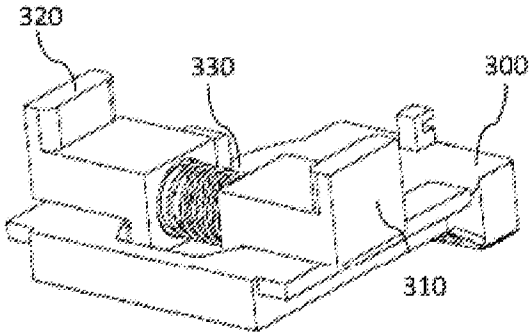
FIG. 6*e* is a perspective view of the locking blocks, release trigger and helical spring assembled outside the CBAD with the locking blocks in the locking position.
Figure 6F:
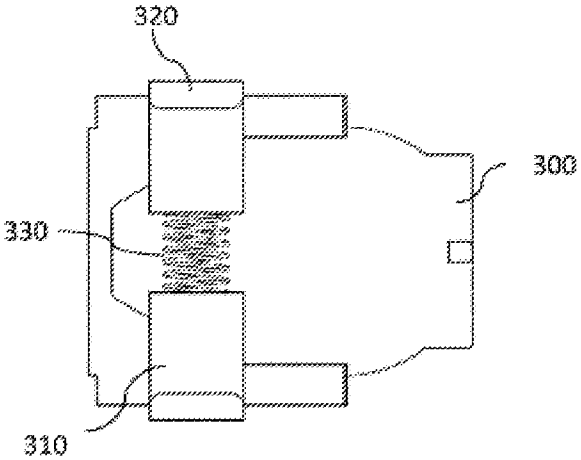
FIG. 6*f* is a top view of the locking blocks, release trigger and helical spring assembled outside the CBAD with the locking blocks in the locking position.

FIGS. 6*a*-6*f*, 7*a*-7*d*, 8*a*-8*b*, 9*a*-9*d*, and 10*a*-10*d*, illustrate how the CBAD module works. Starting with FIGS. 6*a*-6*f*, FIG. 6*a* is a top view of the CBAD with the housing removed to reveal the CBAD components' interaction. FIG. 6*b* illustrates an enlarged view of the component interaction. These aforementioned figures illustrate the interaction between the locking blocks 310 and 320 and the release trigger 300 and notches 264. When the BSS is in the fully collapsed position and the safety is in the "safety on" position, note also the safety bar 370 position is blocking the advancement of the release trigger. The notch 377 (FIG. 5*g*) is directly in front of the front side 304 of the release trigger (FIG. 5*f*), blocking further advancement of the release trigger. In this position the ball 391 on the spring loaded plunger 390 (FIG. 5*i*) is partially inserted into the opening 373 on the safety bar (FIG. 5*h*), this interaction keeps the safety bar from moving inadvertently. Also, extension helical spring 340, maintains tension on the release trigger pulling it away from the safety bar. Two roll pins 280 and 290 form a stop and keep the release trigger from completely retracting and exiting the housing. The locking blocks 310 and 320 are in the extended position and their front sides 314 and 324 (FIG. 5*a*) are resting against the bottom of the notches 264. The locking blocks are biased to stay in the extended position due to the helical spring 330 being disposed between them. This interaction between locking blocks and notches keeps the buttstock in the collapsed position, in this position helical springs 350 (FIG. 3*a*) are partially or fully compressed (FIG. 4*a*). FIGS. 6*c* and 6*d* illustrate a bottom view of the CBAD with the housing removed. FIG. 6*d* is an enlarged view of a portion of the CBAD illustrating the release trigger and its interaction with the safety bar and the locking blocks 310 and 320 resting at the bottom of the notches 264. FIGS. 6*e* and 6*f* illustrate the interaction between the locking blocks 310 and 320, specifically, the tapered surfaces 312 and 322 and the release trigger 300, specifically the contoured geometry 308.

Figure 7A:
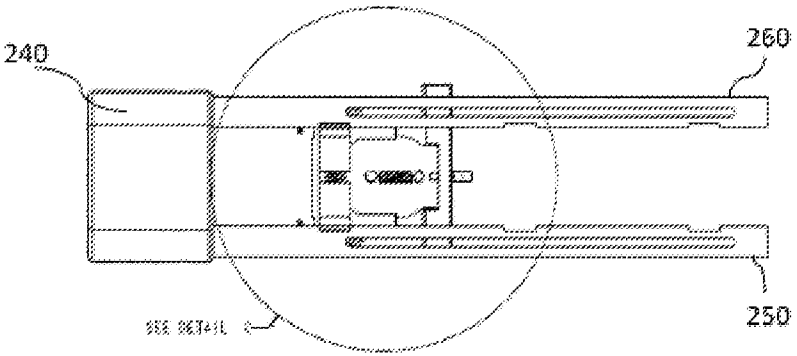
FIG. 7*a* is a top view of the CBAD module—the CBAD module being in the fully collapsed position and the safety bar being in the "Safety off" position. The housing and the buffer tube are removed exposing details of the locking system.
Figure 7B:
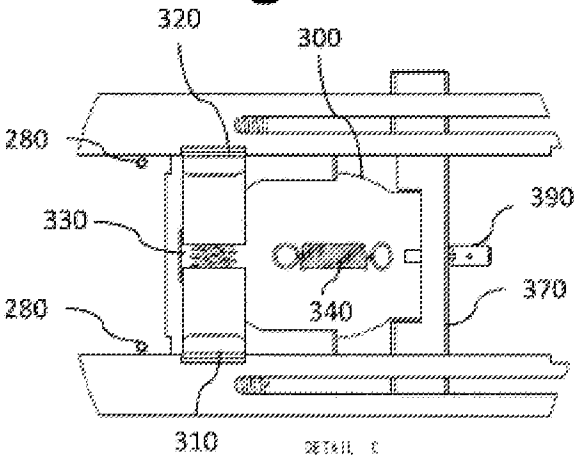
FIG. 7*b* is a detailed view of a portion of the top of the CBAD module of FIG. 7*a*, detailing some of the exposed components of the locking system.
Figure 7C:
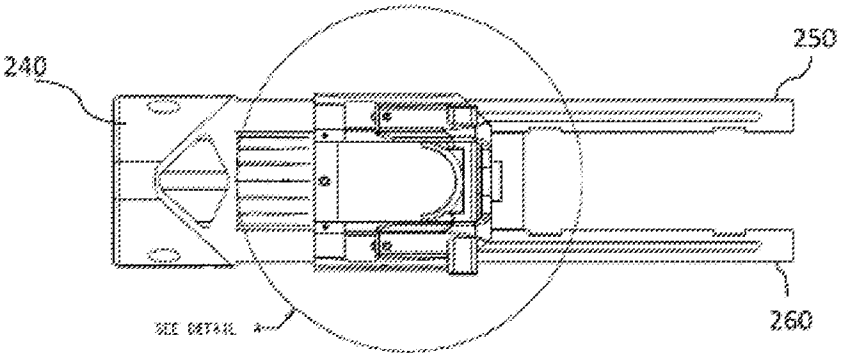
FIG. 7*c* is a bottom view of the CBAD module—the CBAD module being in the fully collapsed position and the safety bar being in the "Safety off" position.
Figure 7D:
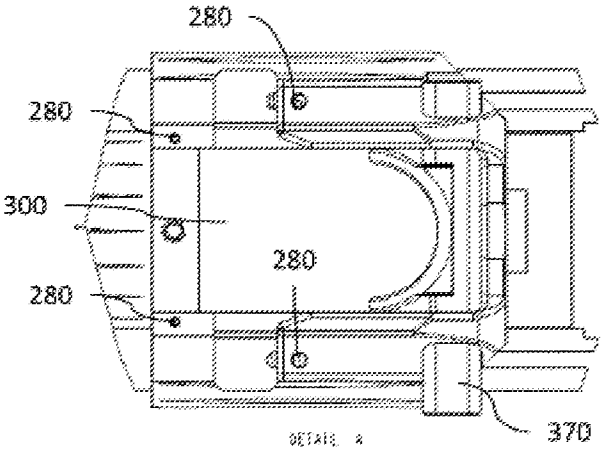
FIG. 7*d* is a detailed view of a portion of the bottom of the CBAD module of FIG. 7*c*, detailing the release trigger.
Figure 8A:
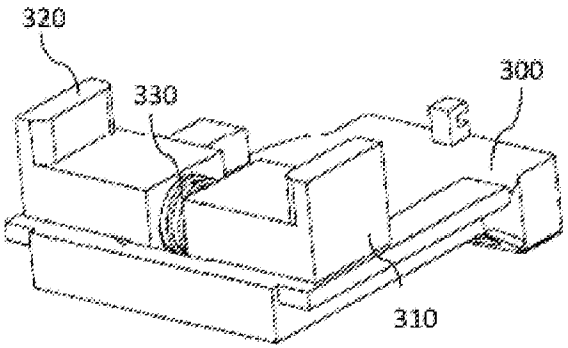
FIG. 8*a* is a perspective view of the locking blocks, release trigger and helical spring assembled outside the CBAD with the locking blocks in the release position.
Figure 8B:
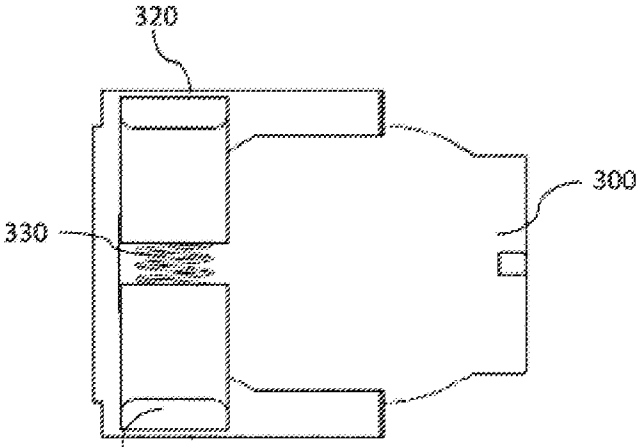
FIG. 8*b* is a top view of the locking blocks, release trigger and helical spring assembled outside the CBAD with the locking blocks in the release position.

FIGS. 7*a*-7*d* illustrate the first stage to releasing the buttstock. Safety bar 270 is moved so that notch 378 (FIG. 5*g*) is directly in front of the release trigger front side 304, the release trigger is pushed forward until its progress is blocked by the far end of notch 378. The interaction between the release trigger contoured surface 308 (FIG. 3*e*) and the tapered surfaces 312 and 322 of the locking blocks , also detailed in FIGS. 8*a* and 8*b*, will cause the locking blocks to retract from their guide rod locking positions. This retraction will result in the release of guide rods 250 and 260, FIGS. 7*a* and 7*b* illustrate the aforementioned steps from a top view of the CBAD, while FIGS. 7*c* and 7*d* illustrate the aforementioned steps from a bottom view of the CBAD.

Figure 9A:
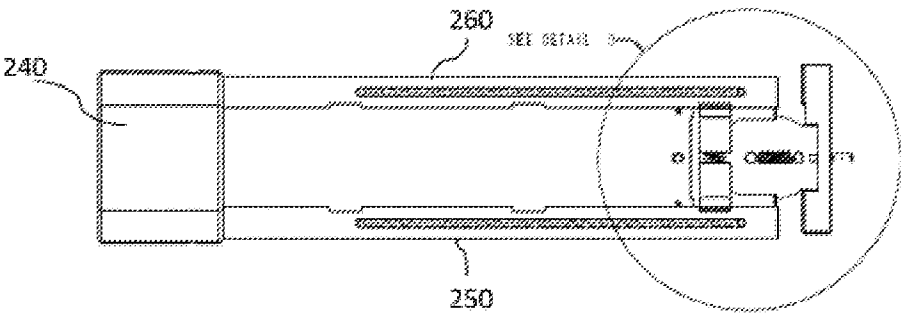
FIG. 9*a* is a top view of the CBAD module—the CBAD module being in the fully extended position and the safety bar being in the "Safety off" position. The housing and the buffer tube are removed exposing details of the locking system.
Figure 9B:
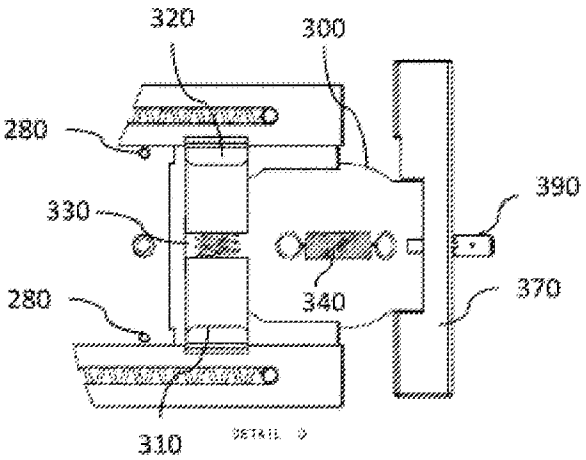
FIG. 9*b* is a detailed view of a portion of the top of the CBAD module of FIG. 9*a*, detailing some of the exposed components of the locking system.
Figure 9C:
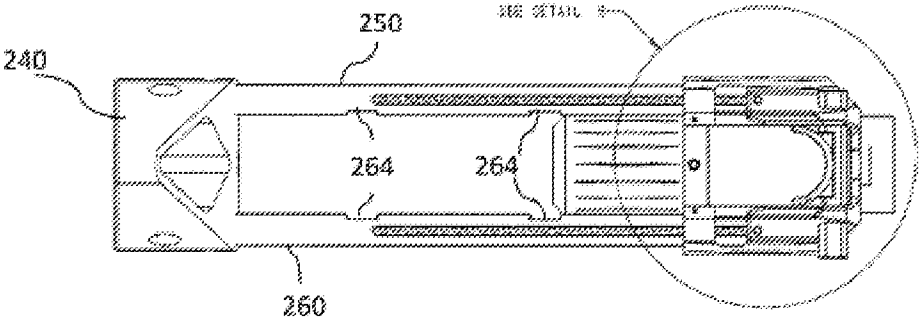
FIG. 9*c* is a bottom view of the CBAD module, CBAD module is in the fully extended position, and the safety bar is on the "Safety off" position.
Figure 9D:
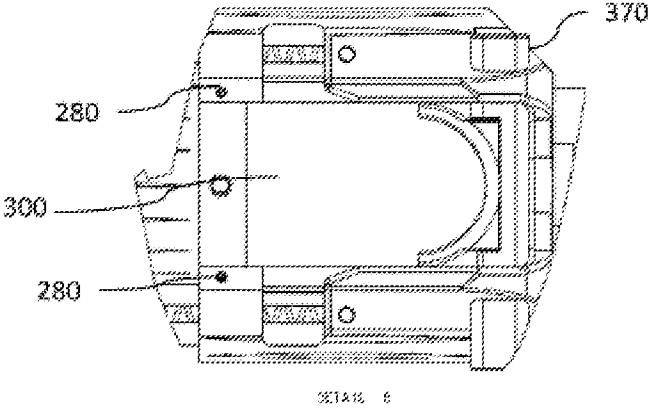
FIG. 9*d* is a detailed view of a portion of the bottom of the CBAD module of FIG. 9*c*, detailing the release trigger.

Upon release of the guide rods, the helical springs 350 which were compressed as illustrated in FIG. 4*a*, are able to expand freely and release the stored energy. Once helical spring is fully expanded (FIG. 4*c*), the shoulder buttstock is in the fully extended position. As the guide rods move, their orientation is maintained due to the interaction between pins 270 and the slots 261. The guide rods will stop any further displacement once the ends 262 of the slots 261 make contact with pins 270. When this occurs, the BSS is in full extension. The positions of the ends 262 of the slots 261 and the notches 264 closest to the front side of the guide rods are directly facing the groove 223, this configuration will allow the locking blocks 310 and 320 to rest into the notches when the blocks are allowed to advance to the locking position. FIG. 9*a* illustrates a top view (with housing removed) of the safety bar 370 in "safety off", release trigger 300 in the advanced position and making contact with the far end of notch 378 (FIG. 5*g*) and the helical springs 350 in the fully extended position. Also, expanded spring 350 is illustrated in FIG. 4*c*. FIG. 9*b* is an enlarged view of the interaction of the aforementioned components. FIGS. 9*c* and 9*d* illustrate a bottom view of the CBAD with the housing removed, and these figures illustrate the aforementioned interaction between the CBAD components.

Figure 10A:
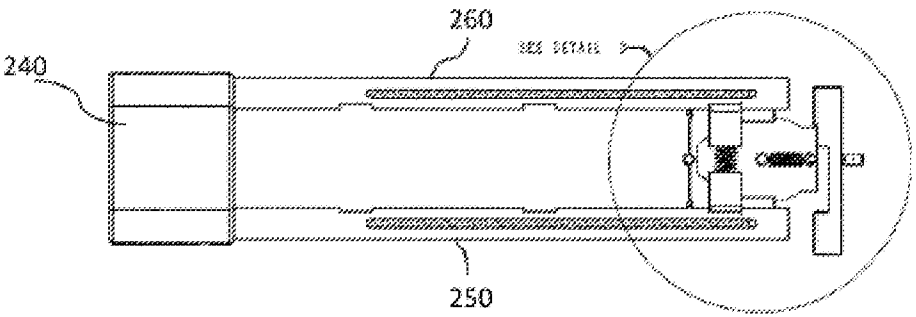
FIG. 10*a* is a top view of the CBAD module—the CBAD module being in the fully extended position and the safety bar being in the "Safety on" position. The housing and the buffer tube are removed exposing details of the locking system.
Figure 10B:
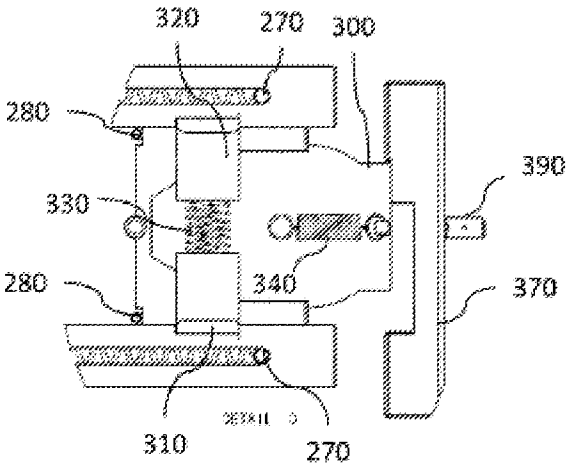
FIG. 10*b* is a detailed view of a portion of the top of the CBAD module of FIG. 10*a*, detailing some of the exposed components of the locking system.
Figure 10C:
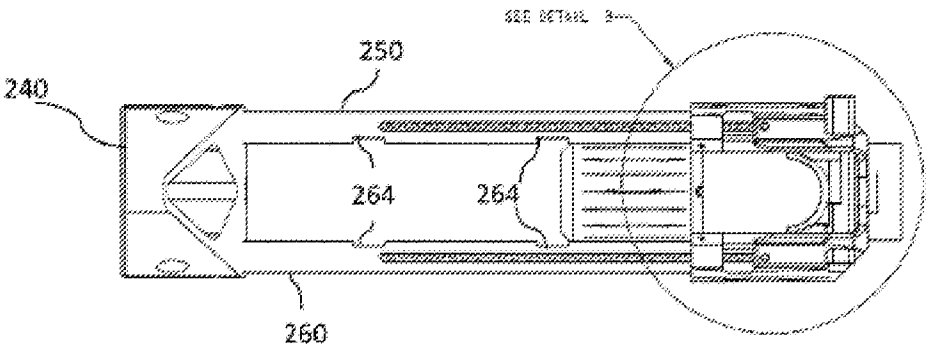
FIG. 10*c* is a bottom view of the CBAD module, CBAD module is in the fully extended position, and the safety bar is on the "Safety on" position.
Figure 10D:
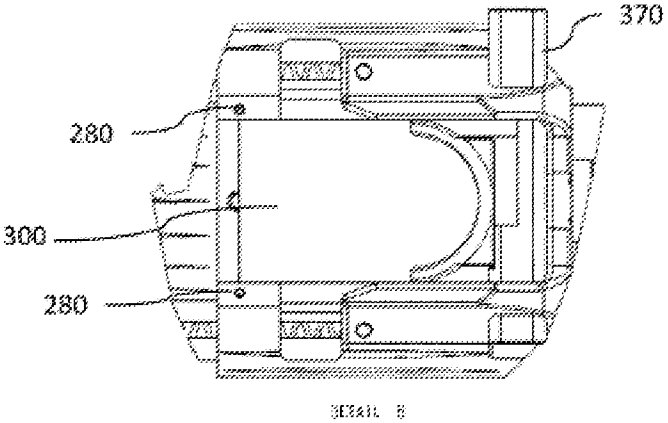
FIG. 10*d* is a detailed view of a portion of the bottom of the CBAD module of FIG. 10*c*, detailing the release trigger.

Finally, the release trigger is retracted, this will occur when forward pressure on it is ceased. The release trigger 300 will retract due to tension in the compression helical spring 340, the spring tension will pull the release trigger back from the safety bar. The release trigger will stop further retraction when it makes contact with roll pins 280. Retraction of the release trigger will cause the locking blocks to advance to the locking position where they will rest in the notch with their front sides 314 and 324, making contact with the bottoms of the notches. The safety bar 370 can be moved to the "safety on" position which will block any forward displacement of the release trigger, thus, locking the buttstock in the fully extended position. FIGS. 10*a* and 10*b* are top views illustrating the aforementioned CBAD components interaction, and FIGS. 10*c* and 10*d* are bottom views illustrating the CBAD components mentioned above.

Figure 11C:
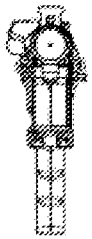
FIG. 11*c* is a front view of a firearm with a CBAD module, of FIG. 11*a*.
Figure 11A:
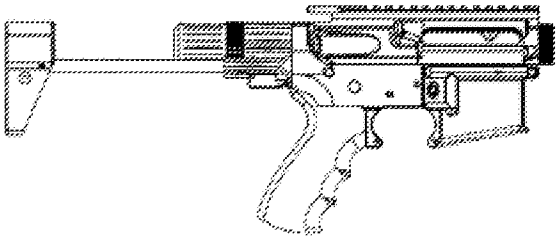
FIG. 11*a* is a side view of a firearm with a CBAD module, the CBAD is in the fully extended position "position 3."
Figure 11B:
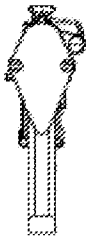
FIG. 11*b* is a rear view of a firearm with a CBAD module, of FIG. 11*a*.
Figure 11F:
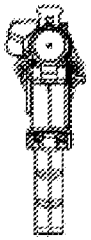
FIG. 11*f* is a front view of a firearm with a CBAD module of FIG. 11*d*.
Figure 11D:
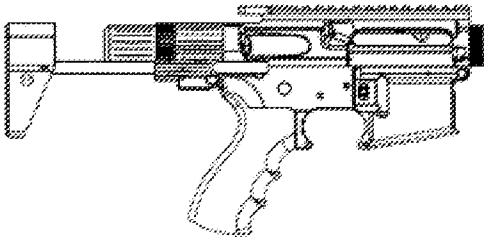
FIG. 11*d* is a side view of a firearm with a CBAD module, the CBAD is in the partially extended position, "position 2."
Figure 11E:
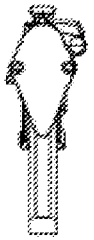
FIG. 11*e* is a rear view of a firearm with a CBAD module of FIG. 11*d*.
Figure 11I:
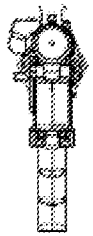
FIG. 11*i* is a front view of a firearm with a CBAD module of FIG. 11*g*.
Figure 11G:
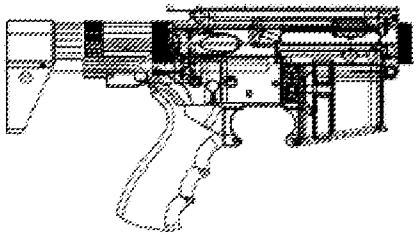
FIG. 11*g* is a side view of a firearm with a CBAD module, the CBAD is in the fully collapsed position, "position 1."
Figure 11H:
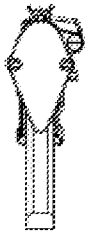
FIG. 11*h* is a rear view of a firearm with a CBAD module of FIG. 11*g*.

As aforementioned, the guide rods 250 and 260 in this embodiment will each have three notches 264. However, it is to be understood that the guide rods can each have four, five or more notches, the number being limited by the space available on the guide rods and by the desired buttstock positions. Each pair of notches (one notch per guide rod) correspond to one BSS position. The BSS collapsed position (position 1) and the fully extended position (position 3) have been discussed. Position 2, which is in between position 1 and position 3, can be accomplished by first placing the safety in the "safety off" position, moving the release trigger forward, then applying pressure onto the BSS 240 to advance it forward. Once the BSS 240 starts advancing pressure should be taken off the release trigger 300, which, in turn, will allow the locking blocks 310 and 320 to be pushed to the locking position. However, the locking blocks will not be able to advance as long as they are touching the outside contour of the guide rods 250 and 260, as the guide rods continue to advance the locking blocks will eventually be aligned with the notches 264. This will allow the locking blocks to advance until their front sides 314 and 324 make contact with the bottoms of the notches. At this instance, the CBAD is locked in position 2. FIG. 11*a* illustrates a side view of the CBAD module attached to a firearm and locked in position 1, figure 11*d* illustrates a side view of the CBAD module to a firearm locked in position 2. FIG. 11*g* illustrates a side view of the CBAD module attached to a firearm locked in position 1.

Figure 12A:
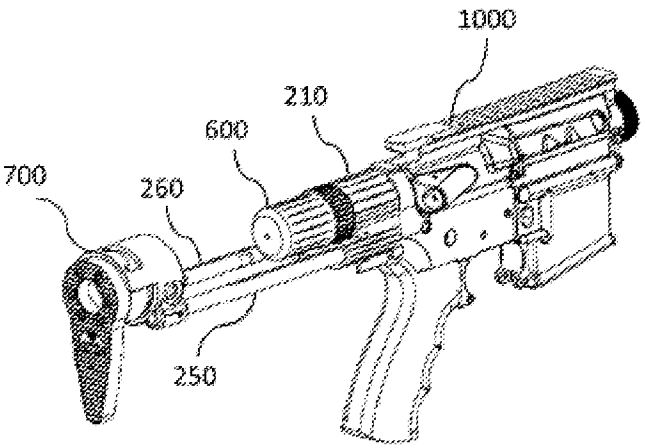
FIG. 12*a* illustrates a rear perspective view of a firearm with a CBAD and a Recoil Mitigation Buffer Floating module (RMBF) attached to it.
Figure 12B:
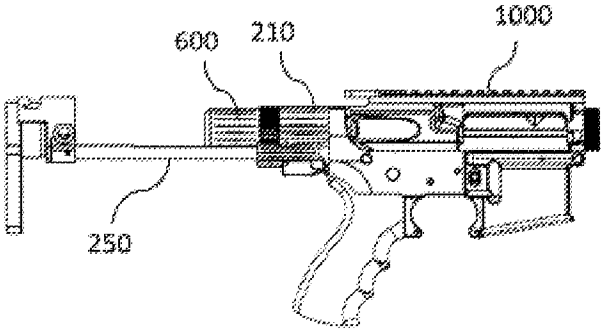
FIG. 12*b* illustrates a side view of the firearm with CBAD of FIG. 12*a*.
Figure 12D:
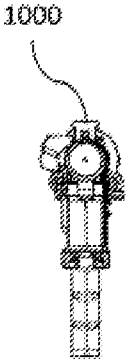
FIG. 12*d* illustrates a front view of the firearm with CBAD of FIG. 12*a*.
Figure 12C:
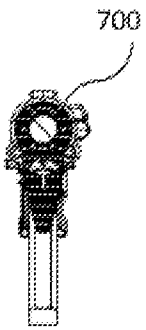
FIG. 12*c* illustrates a back view of the firearm with CBAD of FIG. 12*a*.
Figure 13A:
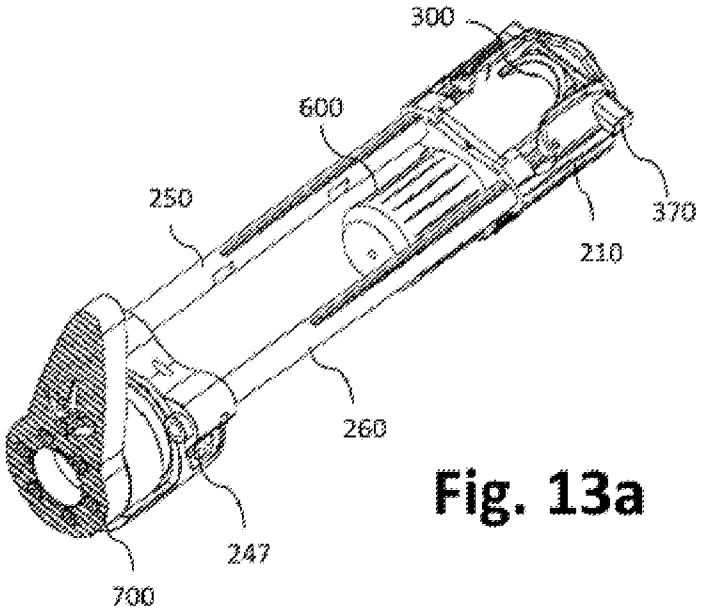
FIG. 13*a* is a bottom perspective view of the CBAD module attached to an RMBF module.
Figure 13B:
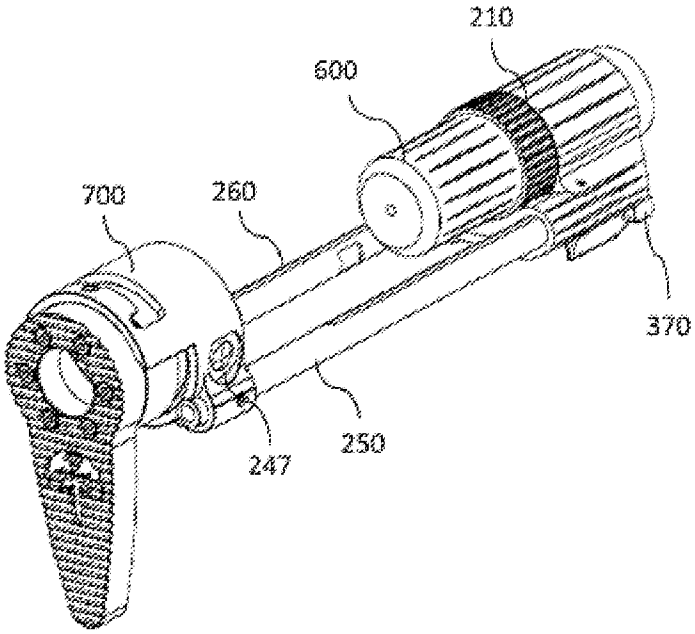
FIG. 13*b* is a rear perspective view of the CBAD module attached to an RMBF module.
Figure 15A:
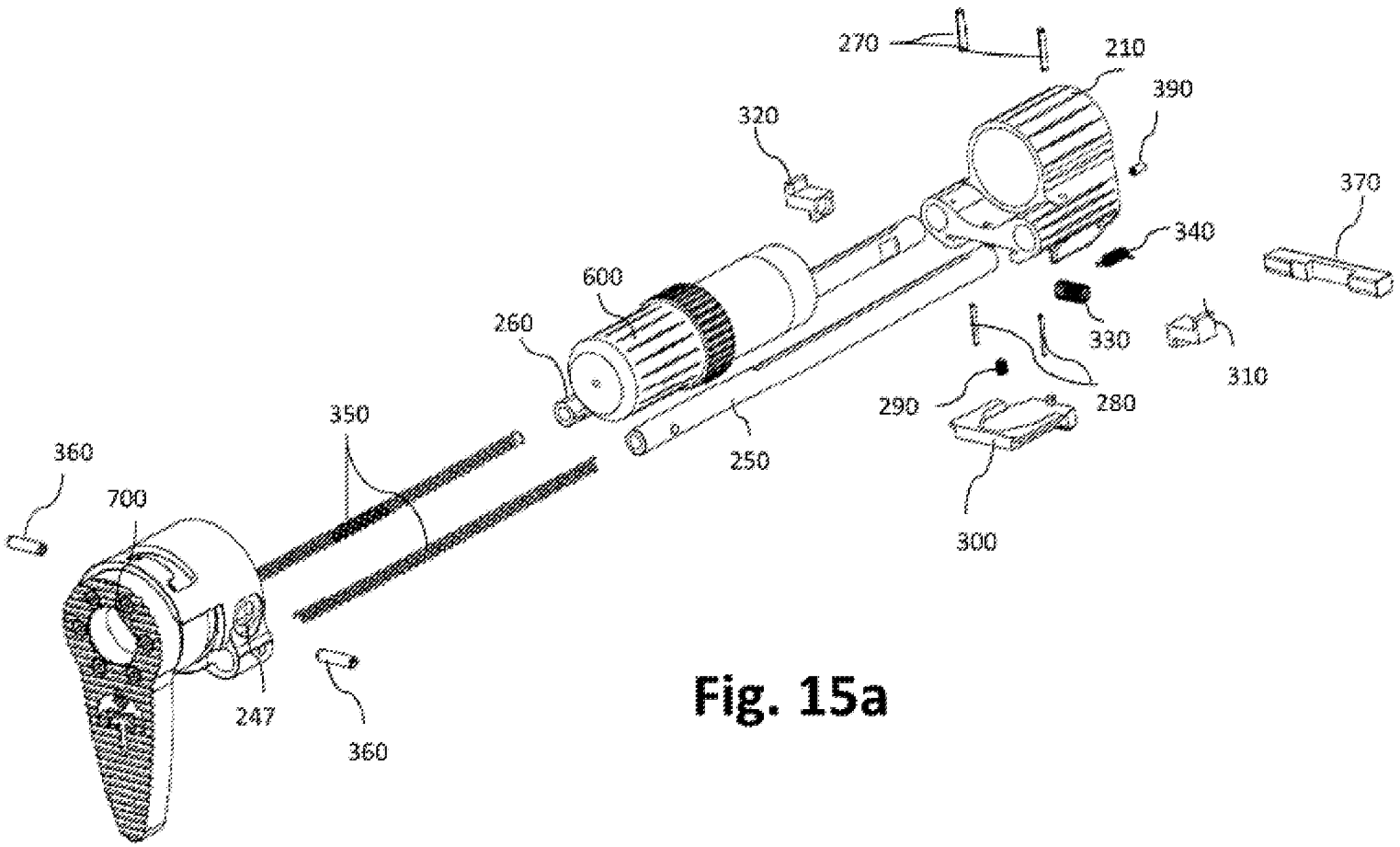
FIG. 15*a* is a rear perspective view of the CBAD module assembly attached to an RMBF module.

In one embodiment, the BSS 240 is replaced with a Recoil Mitigation Buffer Floating module (RMBF), the RMBF is described in detail in patent application # 386480. FIG. 12*a* illustrates a rear perspective view of the CBAD module retrofitted with an RBMF module 700. FIGS. 12*b* is a side view of the same embodiment and FIGS. 12*c* and 12*d* are back view and front views of the same embodiment. FIG. 13*a* is a rear bottom perspective side view of the embodiment and FIG. 13*b* is a perspective rear top view of the embodiment with the firearm removed. FIG. 14 a is a side view of the embodiment with the BSS in position 3, FIG. 14*d* is a side view of the embodiment in position 2, and FIG. 14*g* is a side view of the embodiment in position 1. FIG. 15*a* is a rear perspective assembly view of the CBAD module with the RMBF module attached to it. All the components used in the CBAD module remain the same, the only modification being the replacement of the BSS with the RMBF module.

What is claimed:

1. A collapsible buttstock with automatic deployment, comprising:

a housing with a first opening configured to provide clearance for a buffer tube, a buffer tube traversing the housing longitudinally through the opening and attaching to a firearm;

two or more rods slidably coupled, via respective attachment members, to the housing through respective second openings in the housing, said two or more rods each comprising a hollow cavity configured to accommodate a biasing member for exerting a biasing force against the respective attachment member;

an operator support buttstock element coupled to an end of the two or more rods;

a locking element comprising two or more locking blocks each configured to engage a respective one of plural notches on the two or more rods for locking the two or more rods and the operator support buttstock element in place, each of the two or more locking blocks comprising a tapered surface; and a release trigger with a contoured step configured to engage the tapered surfaces of the two or more locking blocks, wherein when the release trigger is moved by an operator of the firearm, the contoured step engages the tapered surfaces to push the two or more locking blocks away from engagement with the respective notches on the two or more rods, thus allowing a biasing member in each rod to push the respective rod and the operator support buttstock element away from the housing.

* * * * *